US009550093B2

(12) United States Patent
Mimura et al.

(10) Patent No.: US 9,550,093 B2
(45) Date of Patent: Jan. 24, 2017

(54) GOLF BALL

(71) Applicant: DUNLOP SPORTS CO. LTD., Kobe-shi, Hyogo (JP)

(72) Inventors: Kohei Mimura, Kobe (JP); Takahiro Sajima, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/839,387

(22) Filed: Aug. 28, 2015

(65) Prior Publication Data

US 2016/0059081 A1 Mar. 3, 2016

(30) Foreign Application Priority Data

Aug. 29, 2014 (JP) ..... 2014-174960
Jun. 25, 2015 (JP) ..... 2015-127941

(51) Int. Cl.
*A63B 37/06* (2006.01)
*A63B 37/00* (2006.01)

(52) U.S. Cl.
CPC ..... *A63B 37/0006* (2013.01); *A63B 37/009* (2013.01); *A63B 37/0021* (2013.01); *A63B 37/0031* (2013.01); *A63B 37/0033* (2013.01); *A63B 37/0043* (2013.01); *A63B 37/0045* (2013.01); *A63B 37/0075* (2013.01); *A63B 37/0077* (2013.01); *A63B 37/0092* (2013.01); *A63B 37/0096* (2013.01); *A63B 37/0076* (2013.01)

(58) Field of Classification Search
CPC ..... A63B 37/0006; A63B 37/0031
USPC ..... 473/378
See application file for complete search history.

(56) References Cited

U.S. PATENT DOCUMENTS 5,688,194 A * 11/1997 Stiefel ..... A63B 37/0004 33/1 G
6,540,625 B2 * 4/2003 Sajima ..... A63B 37/0004 473/382
2007/0149321 A1 6/2007 Sajima
2007/0173354 A1 7/2007 Sajima
2009/0191982 A1 7/2009 Kim et al.
2012/0004053 A1 1/2012 Kim
2013/0196791 A1 8/2013 Sajima et al.
(Continued)

FOREIGN PATENT DOCUMENTS

JP 2010-188199 A 9/2010

*Primary Examiner* — Raeann Gorden
(74) *Attorney, Agent, or Firm* — Birch, Stewart, Kolasch & Birch, LLP

(57) ABSTRACT

A golf ball 2 includes a core 4, a mid layer 6 and a cover 8. The golf ball 2 further includes a large number of dimples 10 on a surface thereof. The surface has a northern hemisphere N and a southern hemisphere S. Each of the hemispheres has a high-latitude region 14, a mid-latitude region 18 and a low-latitude region 16. The number of planes that can divide a dimple pattern of the hemisphere so that divided dimple patterns are mirror symmetry to each other is one. Neither a dimple pattern of the high-latitude region 14 nor a dimple pattern of the low-latitude region 16 is rotationally symmetrical. A product THm of a thickness and a hardness for the mid layer 6, and a product THc of a thickness and a hardness for the cover 8 satisfy the following mathematical formula.

$THc-THm \leq 50$

7 Claims, 12 Drawing Sheets

(56) References Cited

U.S. PATENT DOCUMENTS

| | | | | |
|---|---|---|---|---|
| 2015/0375047 | A1* | 12/2015 | Sajima | A63B 37/0004 473/383 |
| 2015/0375054 | A1* | 12/2015 | Tachibana | A63B 37/0075 473/374 |
| 2015/0375058 | A1* | 12/2015 | Kamino | A63B 37/0086 473/374 |
| 2016/0059081 | A1* | 3/2016 | Mimura | A63B 37/0006 473/376 |

* cited by examiner

GOLF BALL

This application claims priority on Patent Application No. 2014-174960 filed in JAPAN on Aug. 29, 2014 and Patent Application No. 2015-127941 filed in JAPAN on Jun. 25, 2015. The entire contents of these Japanese Patent Applications are hereby incorporated by reference.

BACKGROUND OF THE INVENTION

Field of the Invention

The present invention relates to golf balls. Specifically, the present invention relates to golf balls that include a core, a mid layer, a cover and dimples.

Description of the Related Art

The greatest interest to golf players concerning golf balls is flight distance. Golf players place importance on flight distance particularly in a shot with a driver. JP2010-188199 discloses a golf ball that includes a core having a great surface hardness and a small central hardness.

Another interest to golf players concerning golf balls is feel at impact. Generally, players prefer soft feel at impact. Players place importance on feel at impact particularly in a shot with a middle iron.

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

A polyhedron is used for arrangement of dimples. The polyhedron is inscribed in a phantom sphere of a golf ball. A large number of sides of the polyhedron is projected on the surface of the phantom sphere by a light beam travelling from the center of the phantom sphere in a radius direction. A large number of comparting lines is obtained on the surface of the phantom sphere by the projection. By the comparting lines, the surface of the phantom sphere is divided into a large number of units (spherical polygons). A large number of dimples is arranged in one unit to obtain a dimple pattern. The dimple pattern is developed over the other units to obtain a dimple pattern of the whole golf ball. This dimple pattern is referred to as a polyhedron pattern.

A dimple pattern referred to as a hemispherically divided pattern is adopted in commercially available golf balls. In designing the pattern, a hemisphere (half of a phantom sphere) is divided into a plurality of units by a plurality of longitude lines. Each unit has a shape of a spherical isosceles triangle. A large number of dimples is arranged in one unit to obtain a dimple pattern. The dimple pattern is developed over the other units. The development is obtained by rotating one unit pattern about a line passing through a north pole and a south pole. By the rotation, a dimple pattern of the whole golf ball is obtained. The pattern of the golf ball is rotationally symmetrical.

The polyhedron pattern is monotonous. In the polyhedron pattern, the turbulization is insufficient. The hemispherically divided pattern is also monotonous. In the hemispherically divided pattern, the turbulization is insufficient.

There have been various proposals for improvement of the hemispherically divided pattern. JP2007-175267 (US2007/0149321) discloses a dimple pattern in which the number of units present in a high-latitude region is different from the number of units present in a low-latitude region. JP2007-195591 (US2007/0173354) discloses a dimple pattern in which the number of types of dimples present in a low-latitude region is greater than the number of types of dimples present in a high-latitude region. JP2013-153966 (US2013/0196791) discloses a dimple pattern in which the density of dimples is high and variations in sizes of dimples are small.

JP2009-172192 (US2009/0191982) discloses a golf ball that has randomly arranged dimples. The dimple pattern of the golf ball is referred to as a random pattern. The random pattern is not monotonous. JP2012-10822 (US2012/0004053) also discloses a golf ball having a random pattern.

Golf players place importance on flight distance in a shot with an iron club as well as flight distance in a shot with a driver. Players particularly place importance on flight distance in a shot with a middle iron and a long iron. A spin rate of a golf ball in hitting with a middle iron is high. If a golf ball having above mentioned improved hemispherically divided pattern is hit with a middle iron, an excessive lift force is generated. The lift force may cause rising of the golf ball during flight. The rising impairs flight distance performance. In addition, in the golf ball, the flight distance depends largely on the rotation axis of backspin. In other words, the golf ball is inferior in stability of flight distance.

As already mentioned, the random pattern is not monotonous. However, the density of dimples in the random pattern is low. In the pattern, suppression of drag is insufficient. When the golf ball is hit with a middle iron, great flight distance cannot be achieved.

An objective of the present invention is to provide a golf ball that has excellent flight performance in a shot with a middle iron.

SUMMARY OF THE INVENTION

A golf ball according to the present invention includes a core, one or more mid layers positioned outside the core, and a cover positioned outside the mid layers. The cover has a Shore D hardness greater than Shore D hardnesses of each of the mid layers by 2 or greater. An average THm of products obtained by multiplying thickness (mm) by hardness (Shore D) for the respective mid layers, and a product THc of a thickness (mm) and a hardness (Shore D) for the cover satisfy the following mathematical formula.

$$THc-THm\leq 50$$

The golf ball further includes a large number of dimples on a surface thereof. When the surface is divided into a northern hemisphere and a southern hemisphere, each of the hemispheres includes a high-latitude region, a mid-latitude region and a low-latitude region. The high-latitude region has a latitude range of equal to or greater than 40° but equal to or less than 90°. The mid-latitude region has a latitude range of equal to or greater than 20° but less than 40°. The low-latitude region has a latitude range of equal to or greater than 0° but less than 20°. The number of planes that can divide a dimple pattern of the hemisphere so that the divided dimple patterns are mirror symmetrical to each other is one. A dimple pattern of the high-latitude region is not rotationally symmetrical. A dimple pattern of the low-latitude region is not rotationally symmetrical.

In the golf ball according to the present invention, a great flight distance is obtained in a shot with a middle iron.

Preferably, the average product THm and the product THc satisfy the following mathematical formula.

$$-50 \leq THc - THm$$

Preferably, a dimple pattern of the mid-latitude region is not rotationally symmetrical.

The high-latitude region may include a pole vicinity region. The pole vicinity region has a latitude range of equal to or greater than 75° but equal to or less than 90°. Preferably, a dimple pattern of the pole vicinity region is rotationally symmetrical.

The low-latitude region may include an equator vicinity region. The equator vicinity region has a latitude range of equal to or greater than 0° but less than 10°. Preferably, a dimple pattern of the equator vicinity region is rotationally symmetrical.

Preferably, a great circle that does not intersect any dimple does not exist on the surface of the golf ball.

Preferably, a ratio of a total area of all the dimples to a surface area of a phantom sphere of the golf ball is equal to or greater than 80%.

DESCRIPTION OF THE PREFERRED EMBODIMENTS

The following will describe in detail the present invention based on preferred embodiments with reference to the accompanying drawings.

Figure 1:
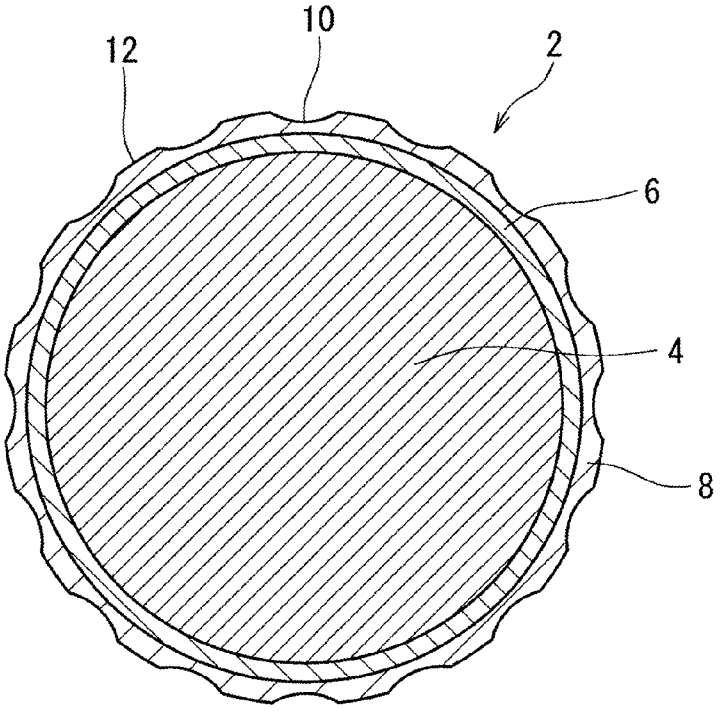
FIG. 1 is a schematic cross-sectional view of a golf ball according to an embodiment of the present invention.

A golf ball 2 shown in FIG. 1 includes a spherical core 4, a mid layer 6 positioned outside the core 4, and a cover 8 positioned outside the mid layer 6. The golf ball 2 has a large number of dimples 10 on a surface thereof. Of the surface of the golf ball 2, a part other than the dimples 10 is a land 12. The golf ball 2 includes a paint layer and a mark layer on the external side of the cover 8, although these layers are not shown in the drawing. The golf ball 2 may include another layer between the core 4 and the mid layer 6. The golf ball 2 may include another layer between the mid layer 6 and the cover 8.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of the preferable base rubber of the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred that the polybutadiene is a principal component. Specifically, the proportion of the polybutadiene to the entire base rubber is preferably equal to or greater than 50% by weight and particularly preferably equal to or greater than 80% by weight. A polybutadiene in which the proportion of cis-1,4 bonds is equal to or greater than 80% is particularly preferred.

The rubber composition of the core 4 preferably includes a co-crosslinking agent. Preferable co-crosslinking agents in light of resilience performance are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance, zinc acrylate and zinc methacrylate are particularly preferred.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the co-crosslinking agent per 100 parts by weight of the base rubber is preferably equal to or greater than 10 parts by weight and particularly preferably equal to or greater than 15 parts by weight. In light of soft feel at impact, the amount is preferably equal to or less than 50 parts by weight and particularly preferably equal to or less than 45 parts by weight.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

In light of resilience performance of the golf ball 2, the amount of the organic peroxide per 100 parts by weight of the base rubber is preferably equal to or greater than 0.1 parts by weight, more preferably equal to or greater than 0.3 parts by weight, and particularly preferably equal to or greater than 0.5 parts by weight. In light of soft feel at impact, the amount is preferably equal to or less than 3.0 parts by weight, more preferably equal to or less than 2.8 parts by weight, and particularly preferably equal to or less than 2.5 parts by weight.

Preferably, the rubber composition of the core 4 includes an organic sulfur compound. Organic sulfur compounds include naphthalenethiol type compounds, benzenethiol type compounds, and disulfide type compounds.

Examples of naphthalenethiol type compounds include 1-naphthalenethiol, 2-naphthalenethiol(2-thionaphthol), 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol type compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide type compounds include diphenyl disulfide, bis(4-chlorophenyl)disulfide, bis(3-chlorophenyl) disulfide, bis(4-bromophenyl)disulfide, bis(3-bromophenyl) disulfide, bis(4-fluorophenyl)disulfide, bis(4-iodophenyl) disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl) disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance of the golf ball 2, the amount of the organic sulfur compound per 100 parts by weight of the base rubber is preferably equal to or greater than 0.1 parts by weight and particularly preferably equal to or greater than 0.2 parts by weight. In light of soft feel at impact, the amount is preferably equal to or less than 1.5 parts by weight, more preferably equal to or less than 1.0 parts by weight, and particularly preferably equal to or less than 0.8 parts by weight.

Preferably, the rubber composition of the core 4 includes a carboxylate. The core 4 including a carboxylate has a small hardness at a vicinity of the central point. The core 4 has an outer-hard/inner-soft structure. When the golf ball 2 having the core 4 is hit with a middle iron, the spin rate is small. The golf ball 2 has an excellent flight performance in a shot with a middle iron. Preferable carboxylates are zinc octoate and zinc stearate. The amount of the carboxylate per 100 parts by weight of the base rubber is preferably equal to or greater than 1 part by weight but equal to or less than 20 parts by weight.

For the purpose of adjusting specific gravity and the like, a filler may be included in the core 4. Examples of suitable fillers include zinc oxide, barium sulfate, calcium carbonate, and magnesium carbonate. The amount of the filler is determined as appropriate so that the intended specific gravity of the core 4 is accomplished. According to need, various additives such as sulfur, an anti-aging agent, a coloring agent, a plasticizer, a dispersant, and the like are included in the rubber composition of the core 4 in an adequate amount. Crosslinked rubber powder or synthetic resin powder may also be included in the core 4.

The core 4 has a diameter of preferably equal to or greater than 33.0 mm. The golf ball 2 that includes the core 4 having a diameter of 33.0 mm or greater is excellent in resilience performance. In this respect, the diameter is more preferably equal to or greater than 34.0 mm, and particularly preferably equal to or greater than 35.0 mm. From the standpoint that the mid layer 6 and the cover 8 can have a sufficient thickness, the diameter is preferably equal to or less than 39.0 mm.

The core 4 has a weight of preferably equal to or greater than 10 g but equal to or less than 40 g. The temperature for crosslinking the core 4 is equal to or higher than 140° C. but equal to or lower than 180° C. The time period for crosslinking the core 4 is equal to or longer than 10 minutes but equal to or shorter than 60 minutes. The core 4 may include two or more layers. The core 4 may have a rib on the surface thereof. The core 4 may be hollow.

The mid layer 6 is positioned between the core 4 and the cover 8. The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferred. Ionomer resins are highly elastic. The golf ball 2 that has the mid layer 6 including an ionomer resin is excellent in resilience performance.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer contains 80% by weight or more but 90% by weight or less of an α-olefin, and 10% by weight or more but 20% by weight or less of an α,βunsaturated carboxylic acid. The binary copolymer is excellent in resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer contains 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer is excellent in resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the mid layer 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

For the purpose of adjusting specific gravity and the like, a filler may be included in the resin composition of the mid layer 6. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the mid layer 6 is accomplished. A coloring agent, crosslinked rubber powder, or synthetic resin powder may also be included in the mid layer 6.

The mid layer 6 has a hardness Hm of preferably equal to or greater than 45 but equal to or less than 65. The golf ball 2 that includes the mid layer 6 having a hardness Hm of 45 or greater is excellent in resilience performance. In this respect, the hardness Hm is more preferably equal to or greater than 48, and particularly preferably equal to or greater than 50. The golf ball 2 that includes the mid layer 6 having a hardness Hm of 65 or less is excellent in feel at impact. In this respect, the hardness Hm is more preferably equal to or less than 60, and particularly preferably equal to or less than 55.

The hardness Hm of the mid layer 6 and a hardness Hc of the cover 8 are measured according to the standards of "ASTM-D 2240-68". For the measurement, an automated rubber-hardness measurement machine (trade name "P1" manufactured by Kobunshi Keiki Co., Ltd.), to which a Shore D type hardness scale is mounted, is used. For the measurement, a sheet that is formed by hot press, is formed from the same material as that of the mid layer 6 (or the cover 8), and has a thickness of approximately 2 mm is used. Prior to the measurement, the sheet is kept at 23° C. for two weeks. At the measurement, three sheets are stacked.

The mid layer 6 has a thickness Tm of preferably equal to or greater than 0.3 mm but equal to or less than 2.5 mm. The golf ball 2 that includes the mid layer 6 having a thickness Tm of 0.3 mm or greater is excellent in feel at impact. In this respect, the thickness Tm is more preferably equal to or greater than 0.5 mm, and particularly preferably equal to or greater than 0.8 mm. The golf ball 2 that includes the mid layer 6 having a thickness Tm of 2.5 mm or less is excellent in resilience performance. In this respect, the thickness Tm is more preferably equal to or less than 2.0 mm, and particularly preferably equal to or less than 1.8 mm.

The golf ball 2 may include two or more mid layers positioned between the core 4 and the cover 8. In this case, it is preferred that each mid layer has a thickness falling within the above range.

The cover 8 is formed from a thermoplastic resin composition. Preferable base polymer of the resin composition is an ionomer resin. The golf ball 2 that has the cover 8 including an ionomer resin is excellent in resilience performance. The ionomer resins mentioned above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 60% by weight, and particularly preferably equal to or greater than 70% by weight.

A preferable resin that can be used in combination with an ionomer resin is an ethylene-(meth)acrylic acid copolymer. The copolymer is obtained by a copolymerization reaction of a monomer composition that contains ethylene and (meth) acrylic acid. In the copolymer, some of the carboxyl groups are neutralized with metal ions. The copolymer includes 3% by weight or greater but 25% by weight or less of a (meth)acrylic acid component. An ethylene-(meth)acrylic acid copolymer having a polar functional group is particularly preferred. A specific example of ethylene-(meth)acrylic acid copolymers is trade name "NUCREL" manufactured by Du Pont-MITSUI POLYCHEMICALS Co., Ltd.

According to need, a coloring agent such as titanium dioxide and a fluorescent pigment, a filler such as barium sulfate, a dispersant, an antioxidant, an ultraviolet absorber, a light stabilizer, a fluorescent material, a fluorescent brightener, and the like are included in the cover 8 in an adequate amount.

The cover 8 has a Shore D hardness Hc of preferably equal to or greater than 50 but equal to or less than 70. The golf ball 2 that includes the cover 8 having a hardness Hc of 50 or greater is excellent in resilience performance. The golf ball 2 has excellent flight performance. In this respect, the hardness Hc is more preferably equal to or greater than 53 and particularly preferably equal to or greater than 55. The golf ball 2 that includes the cover 8 having a hardness Hc of 70 or less is excellent in feel at impact. In this respect, the hardness Hc is more preferably equal to or less than 67 and particularly preferably equal to or less than 65.

The cover 8 has a thickness Tc of preferably equal to or greater than 0.3 mm but equal to or less than 2.5 mm. The golf ball 2 that includes the cover 8 having a thickness Tc of 0.3 mm or greater is excellent in resilience performance. In this respect, the thickness Tc is more preferably equal to or greater than 0.5 mm and particularly preferably equal to or greater than 0.8 mm. The golf ball 2 that includes the cover 8 having a thickness Tc of 2.5 mm or less is excellent in feel at impact. In this respect, the thickness Tc is more preferably equal to or less than 2.0 mm and particularly preferably equal to or less than 1.8 mm.

For forming the cover 8, known methods such as injection molding, compression molding, and the like can be used. When forming the cover 8, the dimples 10 are formed by pimples formed on the cavity face of a mold.

The hardness Hc of the cover 8 is preferably greater than the hardness Hm of the mid layer 6. In the golf ball 2 in which the hardness Hc is greater than the hardness Hm, spin can be suppressed. The golf ball 2 has excellent flight performance in a shot with a middle iron. Preferably, the hardness Hc of the cover 8 is greater than hardnesses of any other layers.

In light of flight performance, a difference (Hc−Hm) between the hardness Hc and the hardness Hm is preferably equal to or greater than 2 and particularly preferably equal to or greater than 5. The difference (Hc−Hm) is preferably equal to or less than 20.

In a golf ball having two or more mid layers, the hardness Hc of the cover 8 is preferably greater than Shore D hardnesses of each of the mid layers. The difference between the hardness Hc of the cover 8 and the hardness of each mid layer is preferably equal to or greater than 2 and particularly preferably equal to or greater than 5. The difference is preferably equal to or less than 20.

The thickness Tm of the mid layer 6 is preferably greater than the thickness Tc of the cover 8. The mid layer 6 can suppress spin. In a golf ball having two or more mid layers, a total thickness of the mid layers is preferably greater than the thickness Tc of the cover 8.

A sum of the thickness Tm of the mid layer 6 and the thickness Tc of the cover 8 is preferably equal to or less than 4.0 mm. The golf ball 2 having the sum of 4.0 mm or less is excellent in feel at impact. In this respect, the sum is more preferably equal to or less than 3.8 mm and particularly preferably equal to or less than 3.6 mm.

A product THm of the thickness Tm (mm) and the hardness Hm (Shore D) for the mid layer 6, and a product THc of the thickness Tc (mm) and the hardness Hc (Shore D) for the cover 8 satisfy the following mathematical formula (1).

$$THc-THm \leq 50 \quad (1)$$

When the golf ball 2 that satisfies the mathematical formula (1) is hit with a middle iron, the spin rate is low. When the golf ball 2 is hit with a middle iron, an excessive lift force is not generated. The golf ball 2 has an excellent flight performance in a shot with a middle iron. With respect to flight performance, the difference (THc−THm) is more preferably equal to or less than 40, and particularly preferably equal to or less than 30.

Preferably, the golf ball 2 satisfies the following mathematical formula (2).

$$-50 \leq THc-THm \quad (2)$$

When the golf ball 2 that satisfies the mathematical formula (2) is hit with a middle iron, soft feel at impact is attained. With respect to feel at impact, the difference (THc−THm) is more preferably equal to or greater than −40, and particularly preferably equal to or greater than −30.

In a golf ball having two or more mid layers, the product of the thickness Tm (mm) and the hardness Hm (Shore D) is calculated for each of the mid layers. The average of the products is the product THm.

Figure 2:
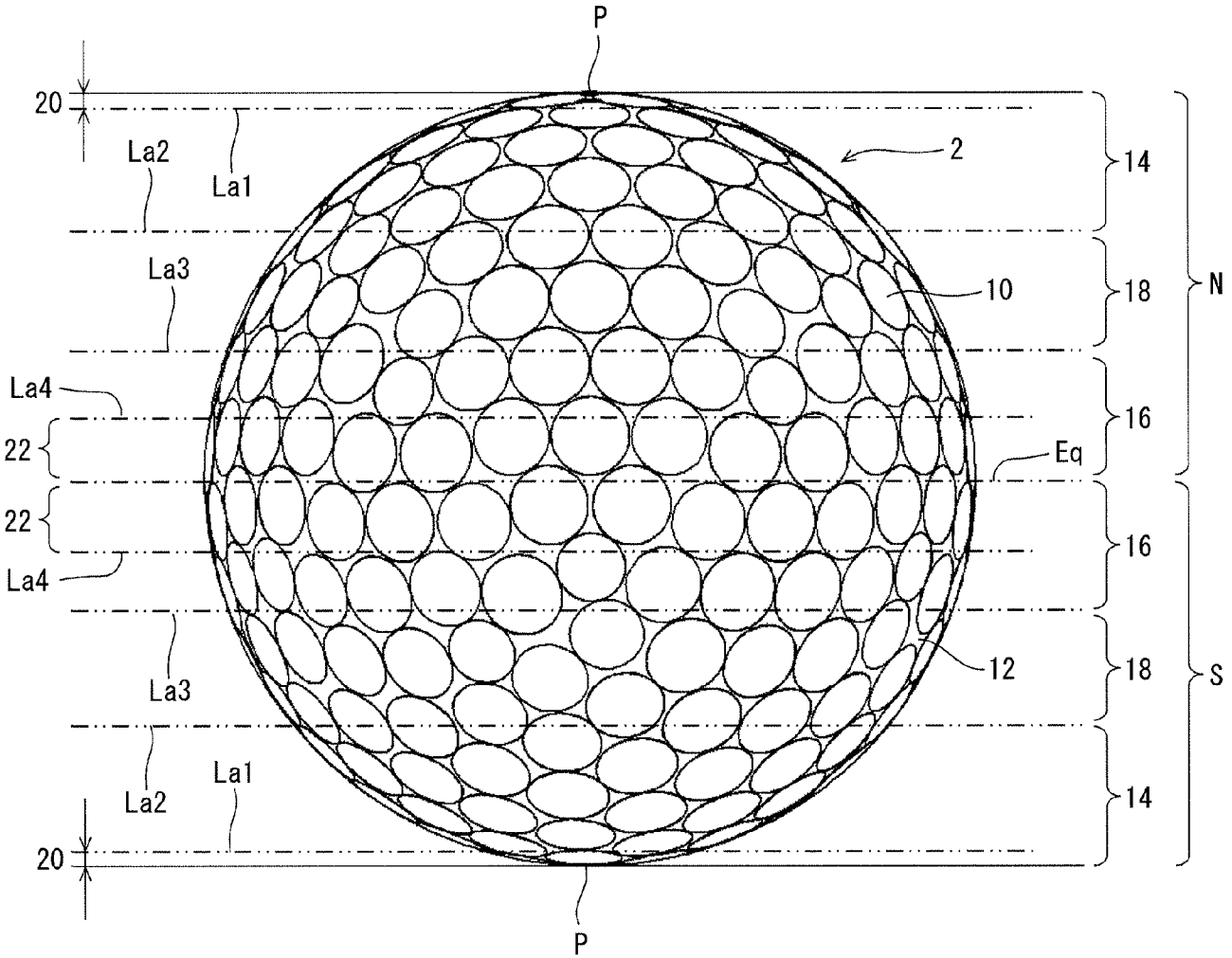
FIG. 2 is an enlarged front view of the golf ball in FIG. 1.

FIG. 2 is an enlarged front view of the golf ball 2 in FIG. 1. FIG. 2 depicts two poles P, two first latitude lines La1, two second latitude lines La2, two third latitude lines La3, two fourth latitude lines La4 and an equator Eq. A mold of the golf ball 2 includes upper and lower mold halves. One of the poles P coincides with the deepest point of the upper mold half. The other pole P coincides with the deepest point of the lower mold half. Each pole P has a latitude of 90°. The equator Eq has a latitude of 0°. The latitude of each first latitude line La1 is greater than the latitude of each second latitude line La2. The latitude of each second latitude line La2 is greater than the latitude of each third latitude line La3. The latitude of each third latitude line La3 is greater than the latitude of each fourth latitude line La4. The latitude of each fourth latitude line La4 is greater than the latitude of the equator Eq (0°). The first latitude line La1 has a latitude of 75°. The second latitude line La2 has a latitude of 40°. The third latitude line La3 has a latitude of 20°. The fourth latitude line La4 has a latitude of 10°.

The golf ball 2 has a northern hemisphere N above the equator Eq and a southern hemisphere S below the equator Eq. The dimple pattern of the southern hemisphere S and the dimple pattern of the northern hemisphere N are symmetrical to each other. Each of the northern hemisphere N and the southern hemisphere S has a high-latitude region 14, a low-latitude region 16, and a mid-latitude region 18. The second latitude line La2 is the boundary line between the high-latitude region 14 and the mid-latitude region 18. The third latitude line La3 is the boundary line between the mid-latitude region 18 and the low-latitude region 16. The high-latitude region 14 is surrounded by the second latitude line La2. The low-latitude region 16 is positioned between the third latitude line La3 and the equator Eq. The mid-latitude region 18 is positioned between the second latitude line La2 and the third latitude line La3. In other words, the mid-latitude region 18 is positioned between the high-latitude region 14 and the low-latitude region 16. The high-latitude region 14 has a latitude range of equal to or greater than 40° but equal to or less than 90°. The mid-latitude region 18 has a latitude range of equal to or greater than 20° but less than 40°. The low-latitude region 16 has a latitude range of equal to or greater than 0° but less than 20°.

The high-latitude region 14 includes a pole vicinity region 20. The pole vicinity region 20 is surrounded by the first latitude line La1. The pole vicinity region 20 has a latitude range of equal to or greater than 75° but equal to or less than 90°.

The low-latitude region 16 includes an equator vicinity region 22. The equator vicinity region 22 is sandwiched between the fourth latitude line La4 and the equator Eq. The equator vicinity region 22 has a latitude range of equal to or greater than 0° but less than 10°.

As is clear from FIG. 2, each of the dimples 10 has a circular plane shape. The golf ball 2 has dimples 10 belonging to the high-latitude region 14, dimples 10 belonging to the mid-latitude region 18, and dimples 10 belonging to the low-latitude region 16. Some of the dimples 10 that belong to the high-latitude region 14 also belong to the pole vicinity region 20. Some of the dimples 10 that belong to the low-latitude region 16 also belong to the equator vicinity region 22.

For each dimple 10 that intersects any one of the latitude lines, the region to which the dimple 10 belongs is determined based on the position of the center of the dimple 10. For example, the dimple 10 that intersects the first latitude line La1 and whose center is located in the pole vicinity region 20 belongs to the pole vicinity region 20. The dimple 10 that intersects the second latitude line La2 and whose center is located in the high-latitude region 14 belongs to the high-latitude region 14. The dimple 10 that intersects the second latitude line La2 and whose center is located in the mid-latitude region 18 belongs to the mid-latitude region 18. The dimple 10 that intersects the third latitude line La3 and whose center is located in the mid-latitude region 18 belongs to the mid-latitude region 18. The dimple 10 that intersects the third latitude line La3 and whose center is located in the low-latitude region 16 belongs to the low-latitude region 16. The dimple 10 that intersects the fourth latitude line La4 and whose center is located in the equator vicinity region 22 belongs to the equator vicinity region 22. The center of the dimple 10 is a point at which a straight line passing through the deepest part of the dimple 10 and the center of the golf ball 2 intersects a phantom sphere Sp (See FIG. 8).

Figure 3:
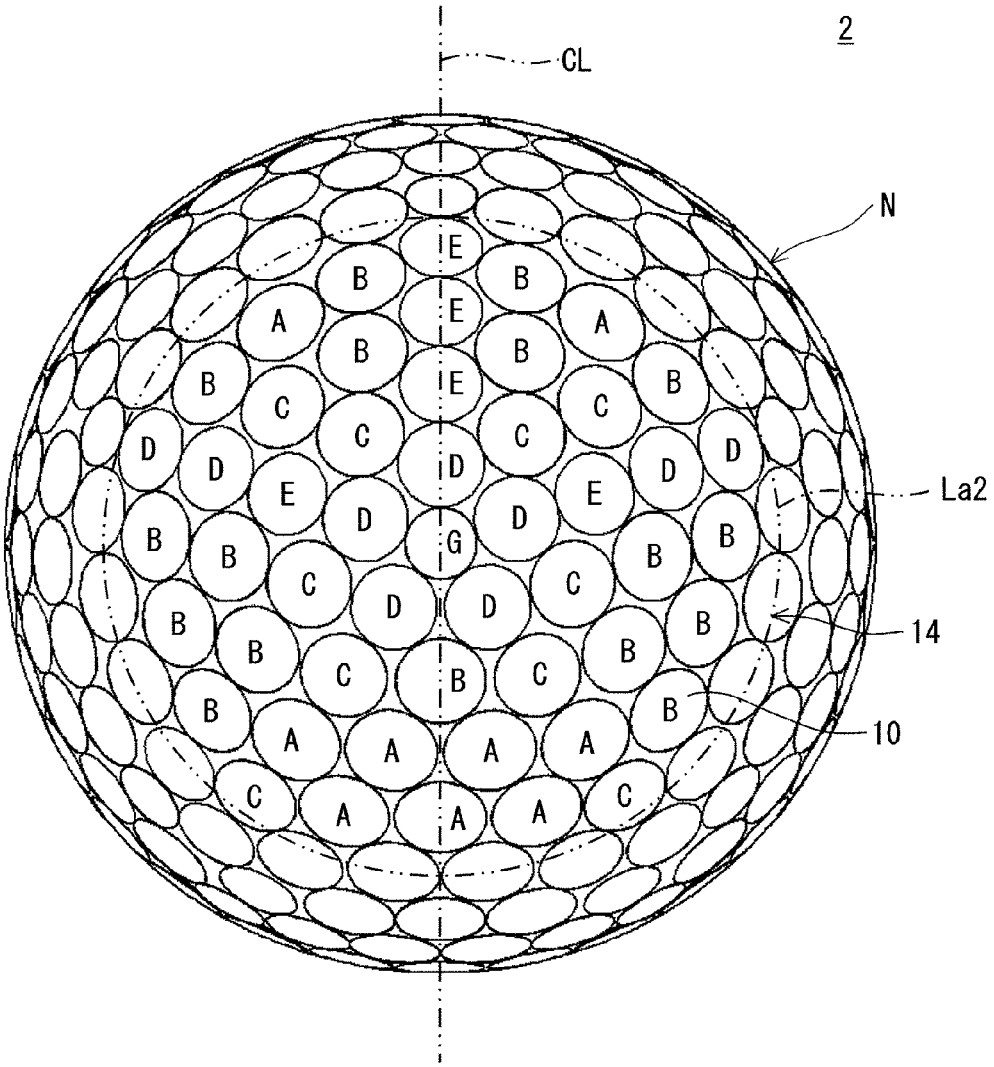
FIG. 3 is a plan view of the golf ball in FIG. 2.

FIG. 3 is a plan view of the golf ball 2 in FIG. 2. FIG. 3 shows the northern hemisphere N. A dimple pattern of the northern hemisphere N in the plan view is symmetrical about a center line CL. Therefore, a three-dimensional dimple pattern is mirror symmetrical about a plane that includes the center line CL and passes through the center of the golf ball 2. Another plane that can divide the dimple pattern so that divided dimple patterns are mirror symmetrical to each other does not exist. The number N2 of planes that can divide the dimple pattern so that divided dimple patterns are mirror symmetrical to each other is one. Also in the southern hemisphere S, the number N2 of planes that can divide the dimple pattern so that divided dimple patterns are mirror symmetrical to each other is one.

FIG. 3 shows the second latitude line La2. A zone surrounded by the second latitude line La2 is the high-latitude region 14. For the high-latitude region 14, types of the dimples 10 are indicated by the reference characters A, B, C, D, E and G. Each of the dimples 10 has a circular contour. The high-latitude region 14 includes: dimples A having a diameter of 4.60 mm; dimples B having a diameter of 4.50 mm; dimples C having a diameter of 4.40 mm; dimples D having a diameter of 4.30 mm; dimples E having a diameter of 4.15 mm; and a dimple G having a diameter of 3.60 mm.

When the dimple pattern of the high-latitude region 14 is rotated about a straight line passing though the both poles P (See FIG. 2), the rotated dimple pattern does not agree with the dimple pattern before the rotation as long as the rotation angle is greater than 0° but less than 360°. In other words, the dimple pattern of the high-latitude region 14 is not rotationally symmetrical.

Figure 4:
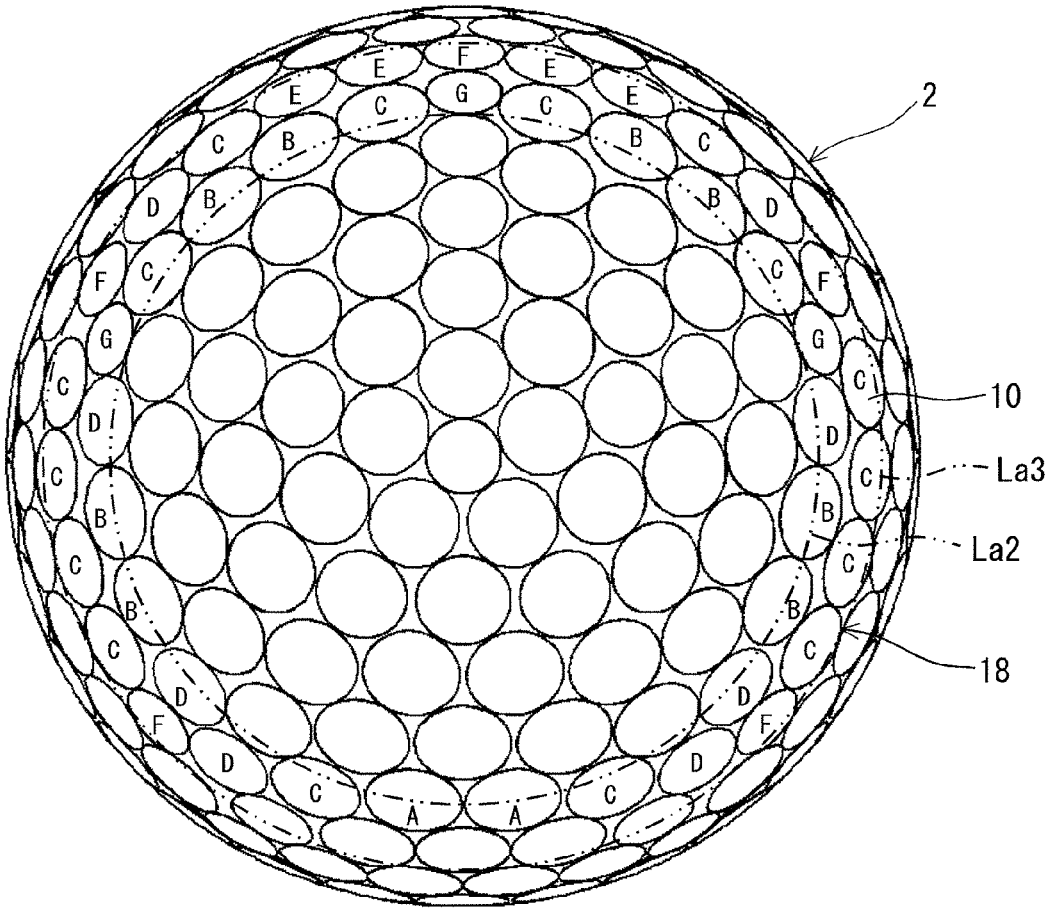
FIG. 4 is a plan view of the golf ball in FIG. 2.

FIG. 4 is a plan view of the golf ball 2 in FIG. 2. FIG. 4 shows the second latitude line La2 and the third latitude line La3. A zone sandwiched between the second latitude line La2 and the third latitude line La3 is the mid-latitude region 18. For the mid-latitude region 18, types of the dimples 10 are indicated by the reference characters B, C, D, E, F and G. Each of the dimples 10 has a circular contour. The mid-latitude region 18 includes: dimples B having a diameter of 4.50 mm; dimples C having a diameter of 4.40 mm; dimples D having a diameter of 4.30 mm; dimples E having a diameter of 4.15 mm; dimples F having a diameter of 3.85 mm; and dimples G having a diameter of 3.60 mm.

When the dimple pattern of the mid-latitude region 18 is rotated about the straight line passing though the both poles P (See FIG. 2), the rotated dimple pattern does not agree with the dimple pattern before the rotation as long as the rotation angle is greater than 0° but less than 360°. In other words, the dimple pattern of the mid-latitude region 18 is not rotationally symmetrical. The dimple pattern of the mid-latitude region 18 may be rotationally symmetrical. In a rotationally-symmetrical dimple pattern, at a rotation angle of greater than 0° but less than 360°, a rotated dimple pattern agrees with the dimple pattern before the rotation.

Figure 5:
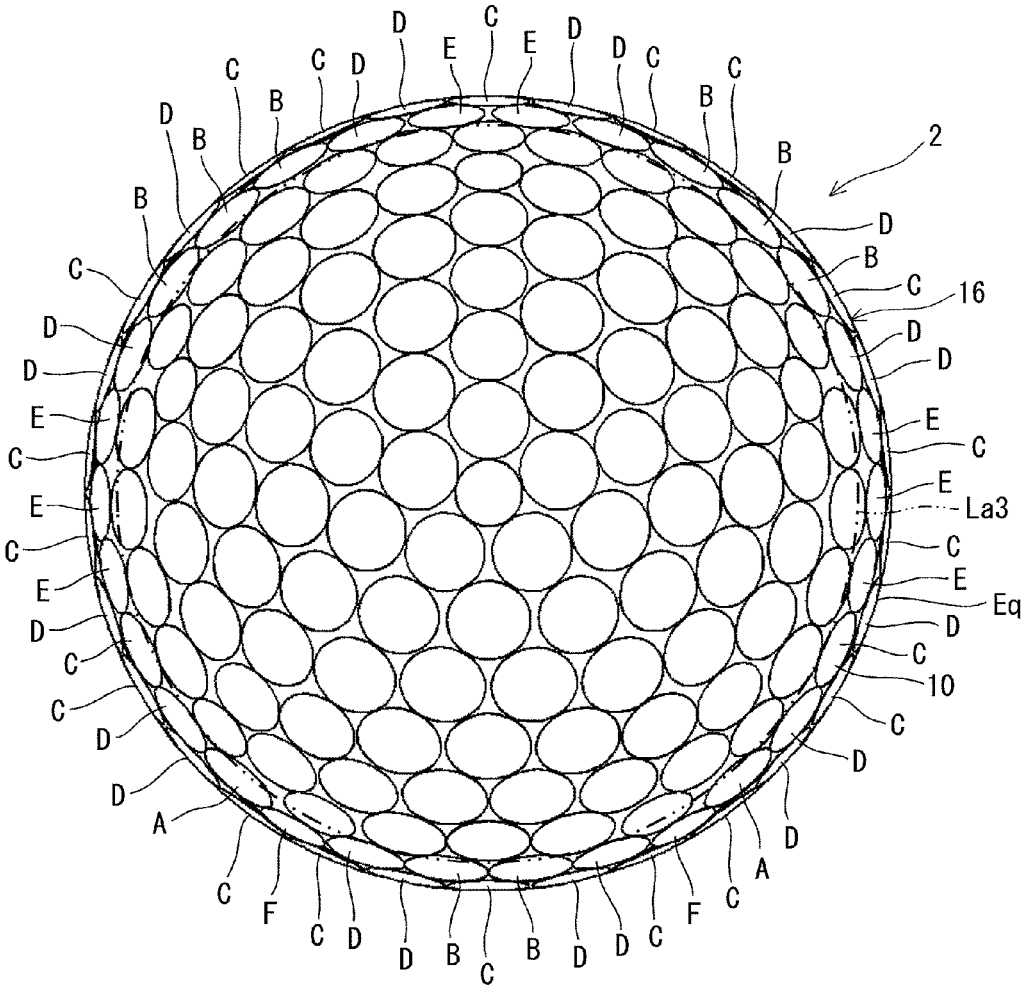
FIG. 5 is a plan view of the golf ball in FIG. 2.

FIG. 5 is a plan view of the golf ball 2 in FIG. 2. FIG. 5 shows the third latitude line La3. A zone sandwiched between the third latitude line La3 and the equator Eq (See FIG. 2) is the low-latitude region 16. For the low-latitude region 16, types of the dimples 10 are indicated by the reference characters A, B, C, D, E and F. Each of the dimples 10 has a circular contour. The low-latitude region 16 includes: dimples A having a diameter of 4.60 mm; dimples B having a diameter of 4.50 mm; dimples C having a diameter of 4.40 mm; dimples D having a diameter of 4.30 mm; dimples E having a diameter of 4.15 mm; and dimples F having a diameter of 3.85 mm.

When the dimple pattern of the low-latitude region 16 is rotated about the straight line passing though the both poles P (See FIG. 2), the rotated dimple pattern does not agree with the dimple pattern before the rotation as long as the rotation angle is greater than 0° but less than 360°. In other words, the dimple pattern of the low-latitude region 16 is not rotationally symmetrical.

In the golf ball 2, as already mentioned, the dimple pattern of the high-latitude region 14 is not rotationally symmetrical, and the dimple pattern of the low-latitude region 16 is not rotationally symmetrical, either. The dimple pattern of the golf ball 2 is not monotonous. The characteristic of the dimple pattern is similar to the characteristic of the random pattern. The dimple pattern accelerates turbulization.

As already mentioned, the dimple pattern of the golf ball 2 can be divided so that divided dimple patterns are mirror symmetrical to each other by a plane including the center line CL. In other words, the dimple pattern has a regularity as compared with a complete random pattern. Therefore, the dimple pattern has a great occupation ratio (to be detailed later). The number of planes that can divide the dimple pattern so that divided dimple patterns are mirror symmetrical to each other is as few as one. Therefore, the dimple pattern in not monotonous.

When the golf ball 2 having a dimple pattern that is not monotonous and has great occupation ratio is hit with a middle iron, an excessive lift force is not generated. The golf ball 2 is excellent in flight distance performance and flight distance stability in a shot with a middle iron.

As already mentioned, in the golf ball 2, the dimple pattern of the mid-latitude region 18 is not rotationally symmetrical, either. The golf ball 2 is extremely excellent in flight performance.

Figure 6:
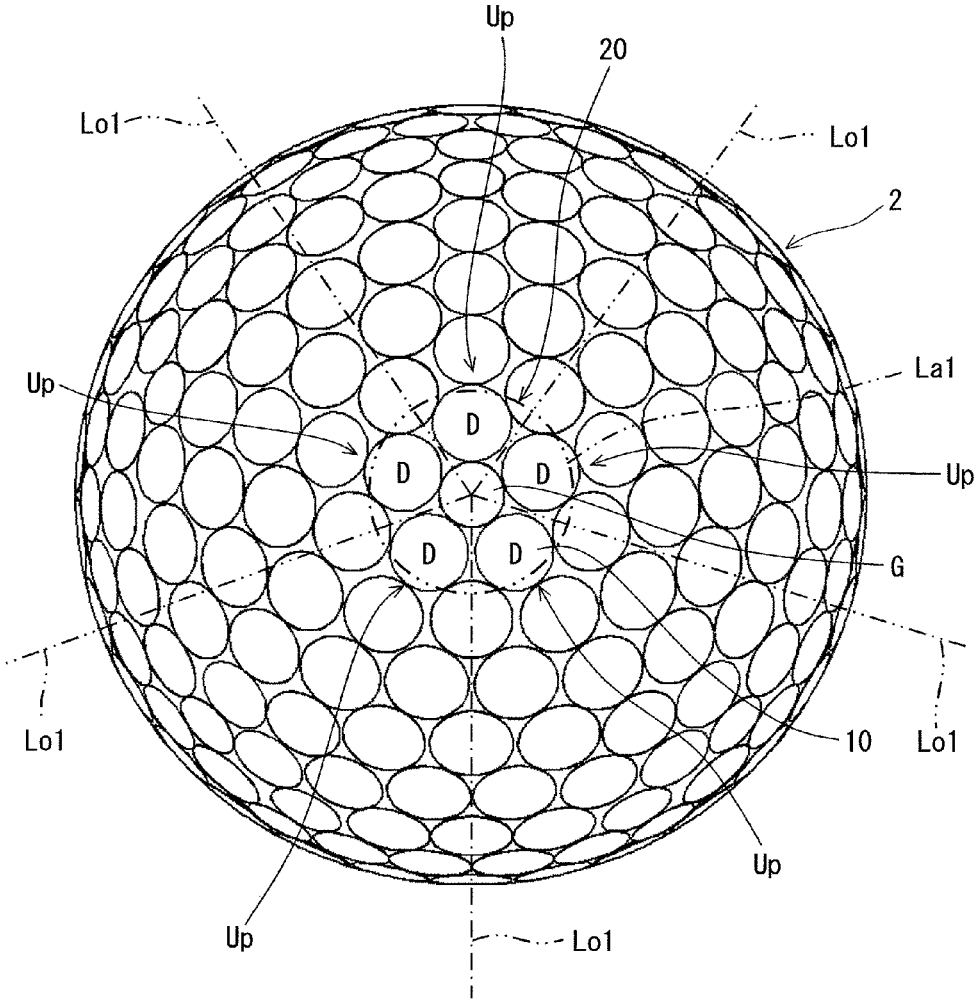
FIG. 6 is a plan view of the golf ball in FIG. 2.

FIG. 6 is a plan view of the golf ball 2 in FIG. 2. FIG. 6 shows the first latitude line La1 and five first longitude lines Lo1. In FIG. 6, a zone surrounded by the first latitude line La1 is the pole vicinity region 20. The pole vicinity region 20 can be divided into five units Up. Each of the units Up has a shape of a spherical triangle. The contour of the unit Up consists of the first latitude line La1 and two first longitude lines Lo1.

The dimple patterns of the five units Up are 72° rotationally symmetrical to each other. In other words, when the dimple pattern of one unit Up is rotated 72° in the latitude direction about the straight line passing through the both poles P (See FIG. 2), it substantially agrees with the dimple pattern of the adjacent unit Up. The rotationally symmetrical angle of the dimple pattern is 72°.

The golf ball 2 having a dimple pattern in the pole vicinity region 20 of rotationally symmetry is excellent in flight distane stability. The number of units of the pole vicinity region 20 is preferably 3 or greater but 6 or less. The pole vicinity region 20 may have a dimple pattern which is not rotationally symmetrical.

Figure 7:
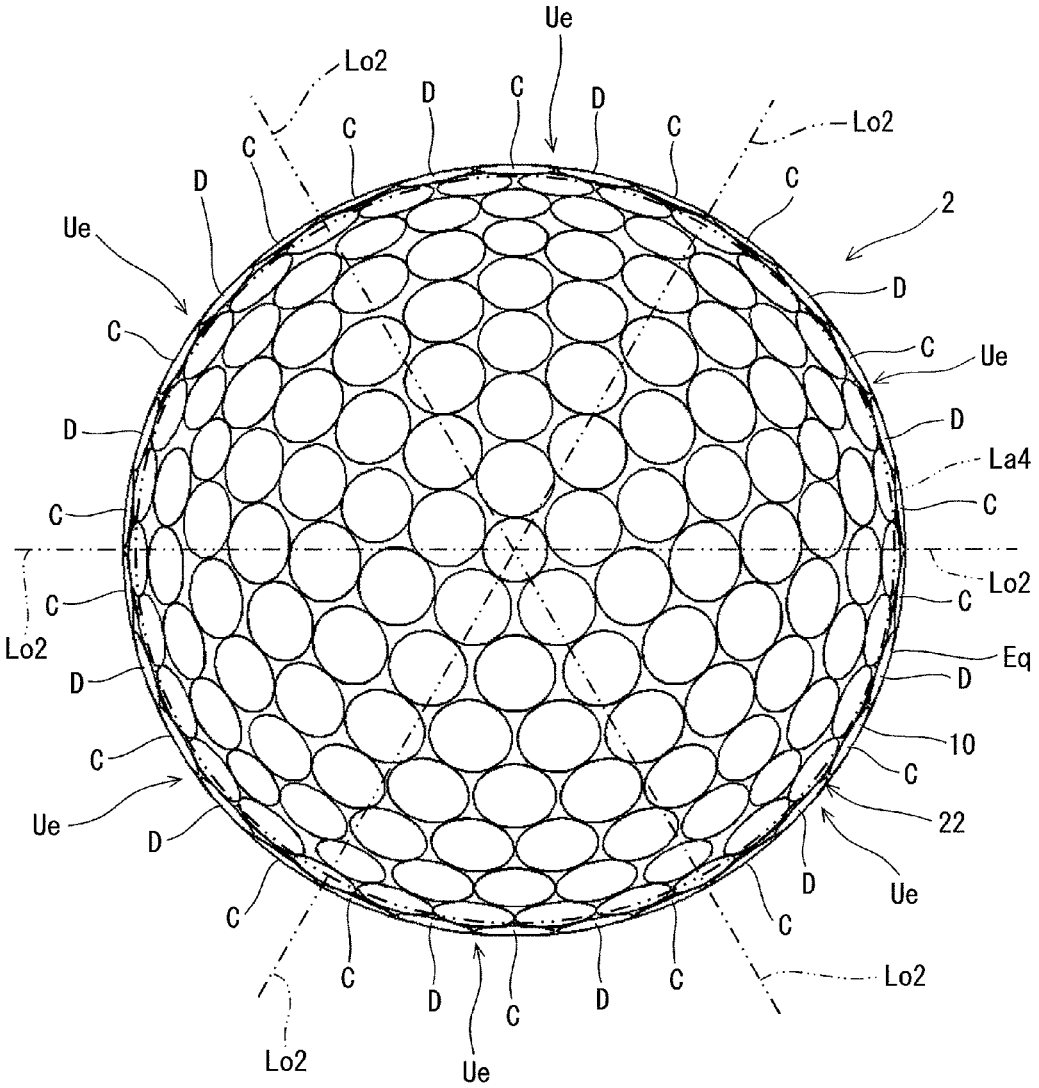
FIG. 7 is a plan view of the golf ball in FIG. 2.

FIG. 7 is a plan view of the golf ball 2 in FIG. 2. FIG. 7 shows the fourth latitude line La4 and six second longitude lines Lo2. In FIG. 7, a zone sandwiched between the fourth latitude line La4 and the equator Eq (See FIG. 2) is the equator vicinity region 22. The equator vicinity region 22 is divided into six units Ue. Each of the units Ue has a shape of a spherical trapezoid. The contour of the unit Ue consists of the fourth latitude line La4, two second longitude lines Lo2, and the equator Eq.

The dimple patterns of the six units Ue are 60° rotationally symmetrical to each other. In other words, when the dimple pattern of one unit Ue is rotated 60° in the latitude direction about the straight line passing through the both poles P (See FIG. 2), it substantially agrees with the dimple pattern of the adjacent unit Ue. The rotationally symmetrical angle of the dimple pattern is 60°.

The dimple pattern of the equator vicinity region 22 can also be divided into three units. In this case, the dimple pattern of each unit is 120° rotationally symmetrical to each other. The dimple pattern of the equator vicinity region 22 can also be divided into two units. In this case, the dimple pattern of each unit is 180° rotationally symmetrical to each other. The dimple pattern of the equator vicinity region 22 has three rotationally symmetrical angles (i.e., 60°, 120° and 180°). A region having a plurality of rotationally symmetrical angles is divided into units Ue based on the smallest rotationally symmetrical angle (60° in this example).

The golf ball 2 having a dimple pattern in the equator vicinity region 22 of rotational symmetry is excellent in flight distane stability. The golf ball 2 having a dimple pattern in the equator vicinity region 22 of rotational symmetry is easy to produce. The number of units of the equator vicinity region 22 is preferably 3 or greater but 6 or less. The equator vicinity region 22 may have a dimple pattern which is not rotationally symmetrical.

A great circle that exists on the surface of the golf ball 2 and that does not intersect any dimple 10 is referred to as a great circle path. The great circle path does not exist on the golf ball 2. The number N3 of the great circle paths is zero. In the golf ball 2, the flight distance does not have much dependence on the rotation axis of backspin. The golf ball 2 is excellent in flight distance stability.

Figure 8:
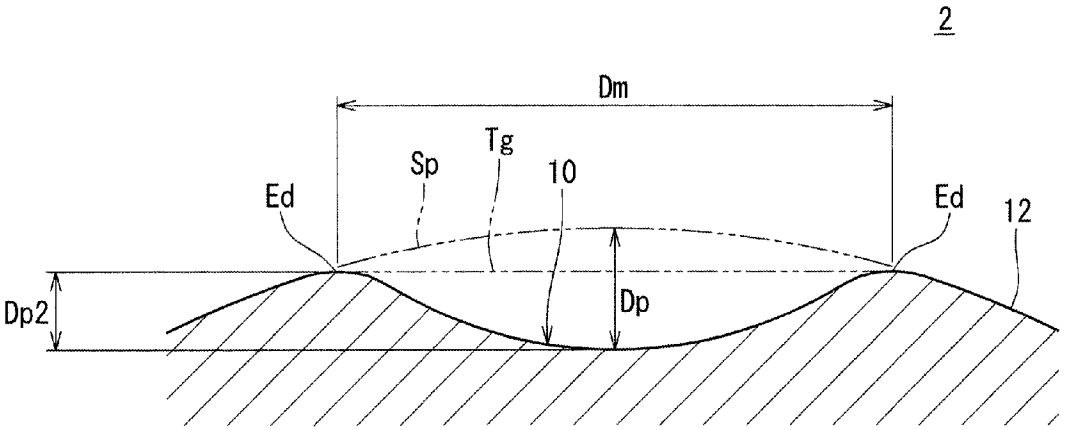
FIG. 8 is a schematic cross-sectional view of a portion of the golf ball in FIG. 1 in an enlarged manner.

FIG. 8 shows a cross section along a plane passing through the center of the dimple 10 and the center of the golf ball 2. In FIG. 8, the top-to-bottom direction is the depth direction of the dimple 10. In FIG. 8, a chain double-dashed line Sp represents a phantom sphere. The surface of the phantom sphere Sp is the surface of the golf ball 2 when it is postulated that no dimple 10 exists. The dimple 10 is recessed from the surface of the phantom sphere Sp. The land 12 coincides with the surface of the phantom sphere Sp. In the present embodiment, the cross-sectional shape of each dimple 10 is substantially a circular arc.

In FIG. 8, a double ended arrow Dm represents the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 8, a double ended arrow Dp represents the depth of the dimple 10. The depth Dp is the distance between the deepest part of the dimple 10 and the phantom sphere Sp.

The diameter Dm of each dimple 10 is preferably equal to or greater than 2.0 mm but equal to or less than 6.0 mm. The dimple 10 having a diameter Dm of 2.0 mm or greater contributes to turbulization. In this respect, the diameter Dm is more preferably equal to or greater than 2.5 mm and particularly preferably equal to or greater than 2.8 mm. The dimple 10 having a diameter Dm of 6.0 mm or less does not impair a fundamental feature of the golf ball 2 being substantially a sphere. In this respect, the diameter Dm is more preferably equal to or less than 5.5 mm and particularly preferably equal to or less than 5.0 mm.

In light of suppression of rising of the golf ball 2 during flight, the depth Dp of each dimple 10 is preferably equal to or greater than 0.10 mm, more preferably equal to or greater than 0.13 mm, and particularly preferably equal to or greater than 0.15 mm. In light of suppression of dropping of the golf ball 2 during flight, the depth Dp is preferably equal to or less than 0.60 mm, more preferably equal to or less than 0.55 mm, and particularly preferably equal to or less than 0.50 mm.

An area S of the dimple 10 is the area of a region surrounded by the contour line of the dimple 10 when the center of the golf ball 2 is viewed at infinity. In case of a circular dimple 10, the area S is calculated by the following formula.

$$S=(Dm/2)^2*\pi$$

In the golf ball 2 shown in FIGS. 2 to 7, the area of the dimple A is 16.62 $mm^2$; the area of the dimple B is 15.90 $mm^2$; the area of the dimple C is 15.21 $mm^2$; the area of the dimple D is 14.52 $mm^2$; the area of the dimple E is 13.53 $mm^2$; the area of the dimple F is 11.64 $mm^2$; and the area of the dimple G is 10.18 $mm^2$.

In the present invention, the ratio of the sum of the areas S of all the dimples 10 to the surface area of the phantom sphere Sp is referred to as an occupation ratio. From the standpoint that a sufficient dimple effect is achieved, the occupation ratio is preferably equal to or greater than 80%, more preferably equal to or greater than 82%, and particularly preferably equal to or greater than 84%. The occupation ratio is preferably equal to or less than 95%. In the golf ball 2 shown in FIGS. 2 to 7, the total area of the dimples 10 is 4812.0 $mm^2$. The surface area of the phantom sphere Sp of the golf ball 2 is 5728.0 $mm^2$, and thus the occupation ratio is 84.0%.

In light of achieving a sufficient occupation ratio, the total number N1 of the dimples 10 is preferably equal to or greater than 250, more preferably equal to or greater than 280, and particularly preferably equal to or greater than 300. From the standpoint that each dimple 10 can contribute to turbulization, the total number N1 is preferably equal to or less than 450, more preferably equal to or less than 400, and particularly preferably equal to or less than 380.

In the present invention, the term "dimple volume" means the volume of a part surrounded by the surface of the dimple 10 and a plane that includes the contour of the dimple 10. The total volume of all the dimples 10 of the golf ball 2 is preferably equal to or greater than 260 $mm^3$ but equal to or less than 360 $mm^3$, and particularly preferably equal to or greater than 290 $mm^3$ but equal to or less than 330 $mm^3$.

EXAMPLES

Example 1

A rubber composition was obtained by kneading 100 parts by weight of a high-cis polybutadiene (trade name "BR-730" manufactured by JSR Corporation), 27 parts by weight of zinc diacrylate, 10 parts by weight of zinc stearate, 5 parts by weight of zinc oxide, an adequate amount of barium sulfate, 0.2 parts by weight of 2-thionaphthol, and 0.75 parts by weight of dicumyl peroxide. This rubber composition was placed into a mold including upper and lower mold halves each having a hemispherical cavity, and heated at 170° C. for 18 minutes to obtain a core with a diameter of 37.5 mm. An amount of compressive deformation CD of the core which was measured under the conditions of: an initial load of 98 N; and a final load of 1274 N, was 3.9 mm.

A resin composition J3 was obtained by kneading 43 parts by weight of an ionomer resin (the aforementioned trade name "Himilan AM7337"), 40 parts by weight of another ionomer resin (the aforementioned trade name "Himilan AM7329"), 17 parts by weight of a styrene block-containing thermoplastic elastomer (the aforementioned trade name "Rabalon T3221C"), and 3 parts by weight of titanium dioxide with a twin-screw kneading extruder. The core was covered with the resin composition J3 by injection molding to form a mid layer with a thickness of 1.6 mm.

A resin composition J2 was obtained by kneading 25 parts by weight of an ionomer resin (the aforementioned trade name "Himilan AM7337"), 50 parts by weight of another ionomer resin (the aforementioned trade name "Himilan AM7329"), 25 parts by weight of an ethylene-(meth)acrylic acid copolymer (trade name "NUCREL N1050H" manufactured by Du Pont-MITSUI POLYCHEMICALS Co., Ltd), 3 parts by weight of titanium dioxide and 0.2 parts by weight of TINUVIN 770 with a twin-screw kneading extruder. The sphere consisting of the core and the mid layer was placed into a final mold having a large number of pimples on its cavity face. The mid layer was covered with the resin composition J2 by injection molding to form a cover with a thickness of 1.0 mm. Dimples having a shape that is the inverted shape of the pimples were formed on the cover.

A clear paint including a two-component curing type polyurethane as the base material was applied to this cover to obtain a golf ball of Example 1 with a diameter of approximately 42.7 mm and a weight of approximately 45.6 g. The specifications D1 of the dimples of the golf ball are shown in Tables 2 and 3 below.

Examples 2 and 6 to 8 and Comparative Example 1

Golf balls of Examples 2 and 6 to 8 and Comparative Example 1 were obtained in the same method as Example 1, except the specifications of the core, the mid layer and the cover were as shown in Tables 4 and 5 below. The compositions of the mid layer and the cover are shown in detail in Table 1 below. The composition of the core is the same as the composition of the core of Example 1.

Examples 9 and 10 and Comparative Example 3

Golf balls of Examples 9 and 10 and Comparative Example 3 were obtained in the same method as Example 1, except the specifications of the dimples were as shown in Table 6 below. The specifications of the dimples are shown in detail in Tables 2 and 3 below.

Comparative Example 4

A golf ball of Comparative Example 4 was obtained in the same method as Example 8, except the specifications of the dimples were as shown in Table 6 below. The specifications of the dimples are shown in detail in Table 3 below.

Example 3

A rubber composition was obtained by kneading 100 parts by weight of a high-cis polybutadiene (trade name "BR-730" manufactured by JSR Corporation), 27 parts by weight of zinc diacrylate, 10 parts by weight of zinc stearate, 5 parts by weight of zinc oxide, an adequate amount of barium sulfate, 0.2 parts by weight of 2-thionaphthol, and 0.75 parts by weight of dicumyl peroxide. This rubber composition was placed into a mold including upper and lower mold halves each having a hemispherical cavity, and heated at 170° C. for 18 minutes to obtain a core with a diameter of 36.7 mm. An amount of compressive deformation CD of the core was 3.9 mm.

A resin composition J5 was obtained by kneading 26 parts by weight of an ionomer resin (the aforementioned trade name "Himilan AM7337"), 40 parts by weight of another ionomer resin (the aforementioned trade name "Himilan AM7329"), 34 parts by weight of a styrene block-containing thermoplastic elastomer (the aforementioned trade name "Rabalon T3221C"), and 6 parts by weight of titanium dioxide with a twin-screw kneading extruder. The core was covered with the resin composition J5 by injection molding to form a first mid layer with a thickness of 0.8 mm.

A resin composition J4 was obtained by kneading 53 parts by weight of an ionomer resin (the aforementioned trade name "Himilan AM7337"), 27 parts by weight of another ionomer resin (the aforementioned trade name "Himilan AM7329"), 20 parts by weight of a styrene block-containing thermoplastic elastomer (the aforementioned trade name "Rabalon T3221C"), and 6 parts by weight of titanium dioxide with a twin-screw kneading extruder. The first mid layer was covered with the resin composition J4 by injection molding to form a second mid layer with a thickness of 1.0 mm.

A resin composition J1 was obtained by kneading 35 parts by weight of an ionomer resin (the aforementioned trade name "Himilan 1555"), 63 parts by weight of another ionomer resin (the aforementioned trade name "Himilan AM7329"), 2 parts by weight of a styrene block-containing thermoplastic elastomer (the aforementioned trade name "Rabalon T3221C"), 3 parts by weight of titanium dioxide and 0.2 parts by weight of TINUVIN 770 with a twin-screw kneading extruder. The sphere consisting of the core, the first mid layer and the second mid layer was placed into a final mold having a large number of pimples on its cavity face. The second mid layer was covered with the resin composition J1 by injection molding to form a cover with a thickness of 1.2 mm. Dimples having a shape that is the inverted shape of the pimples were formed on the cover.

A clear paint including a two-component curing type polyurethane as the base material was applied to this cover to obtain a golf ball of Example 3 with a diameter of approximately 42.7 mm and a weight of approximately 45.6 g. The specifications D1 of the dimples of the golf ball are shown in Tables 2 and 3 below.

Examples 4 and 5

Golf balls of Examples 4 and 5 were obtained in the same method as Example 3, except the specifications of the core, the first mid layer, the second mid layer and the cover were as shown in Table 4 below. The compositions of the first mid layer, the second mid layer and the cover are shown in detail in Table 1 below. The composition of the core is the same as the composition of the core of Example 3.

[Flight Test]

A #7-iron (trade name "SRIXON Z725" manufactured by DUNLOP SPORTS CO. LTD., shaft hardness: S, loft angle: 32.0° was attached to a swing machine manufactured by True Temper Co. A golf ball was hit under the condition of a head speed of 34 m/sec, and the spin rate and the carry were measured. The results are shown in Tables 4 to 6 below.

[Sensuous Evaluation]

Ten golf players hit golf balls with #7-irons, and were asked about feel at impact. The evaluation was categorized as follows based on the number of golf players who answered "the feel at impact was favorable".

A: 8 to 10

B: 5 to 7

C: 2 to 4

D: 0 to 1

The results are shown in Tables 4 to 6 below.

TABLE 1

Compositions of Mid layer and Cover (parts by weight)

| | J1 | J2 | J3 | J4 | J5 |
|---|---|---|---|---|---|
| Himilan AM7337 | — | 25 | 43 | 53 | 26 |
| Himilan 1555 | 35 | — | — | — | — |
| Himilan AM7329 | 63 | 50 | 40 | 27 | 40 |
| NUCREL N1050H | — | 25 | — | — | — |
| Rabalon T3221C | 2 | — | 17 | 20 | 34 |
| Titanium dioxide (A220) | 3 | 3 | 6 | 6 | 6 |
| TINUVIN 770 | 0.2 | 0.2 | — | — | — |
| Hardness (Shore D) | 63 | 60 | 55 | 50 | 45 |

TABLE 2

Specifications of Dimples

| | Type | Number of dimples | Diameter Di (mm) | Depth Dp2 (mm) | Depth Dp (mm) | Curvature radius (mm) | Volume ($mm^3$) | Total Volume ($mm^3$) |
|---|---|---|---|---|---|---|---|---|
| D1 | A | 30 | 4.60 | 0.135 | 0.2592 | 19.66 | 1.123 | 33.7 |
| | B | 68 | 4.50 | 0.135 | 0.2539 | 18.82 | 1.075 | 73.1 |
| | C | 92 | 4.40 | 0.135 | 0.2487 | 17.99 | 1.028 | 94.5 |
| | D | 74 | 4.30 | 0.135 | 0.2435 | 17.19 | 0.982 | 72.6 |
| | E | 38 | 4.15 | 0.135 | 0.2361 | 16.01 | 0.914 | 34.7 |
| | F | 14 | 3.85 | 0.135 | 0.2220 | 13.79 | 0.787 | 11.0 |
| | G | 8 | 3.60 | 0.135 | 0.2110 | 12.07 | 0.688 | 5.5 |
| D2 | A | 30 | 4.60 | 0.135 | 0.2592 | 19.66 | 1.123 | 33.7 |
| | B | 68 | 4.50 | 0.135 | 0.2539 | 18.82 | 1.075 | 73.1 |
| | C | 96 | 4.40 | 0.135 | 0.2487 | 17.99 | 1.028 | 98.7 |
| | D | 66 | 4.30 | 0.135 | 0.2435 | 17.19 | 0.982 | 64.8 |
| | E | 38 | 4.15 | 0.135 | 0.2361 | 16.01 | 0.914 | 34.7 |
| | F | 14 | 3.85 | 0.135 | 0.2220 | 13.79 | 0.787 | 11.0 |
| | G | 12 | 3.60 | 0.135 | 0.2110 | 12.07 | 0.688 | 8.3 |
| D3 | A | 14 | 4.60 | 0.135 | 0.2592 | 19.66 | 1.123 | 15.7 |
| | B | 62 | 4.50 | 0.135 | 0.2539 | 18.82 | 1.075 | 66.6 |
| | C | 72 | 4.40 | 0.135 | 0.2487 | 17.99 | 1.028 | 74.0 |
| | D | 92 | 4.30 | 0.135 | 0.2435 | 17.19 | 0.982 | 90.3 |
| | E | 46 | 4.15 | 0.135 | 0.2361 | 16.01 | 0.914 | 42.1 |
| | F | 16 | 3.85 | 0.135 | 0.2220 | 13.79 | 0.787 | 12.6 |
| | G | 20 | 3.60 | 0.135 | 0.2110 | 12.07 | 0.688 | 13.8 |

TABLE 3

Specifications of Dimples

Figure 9:
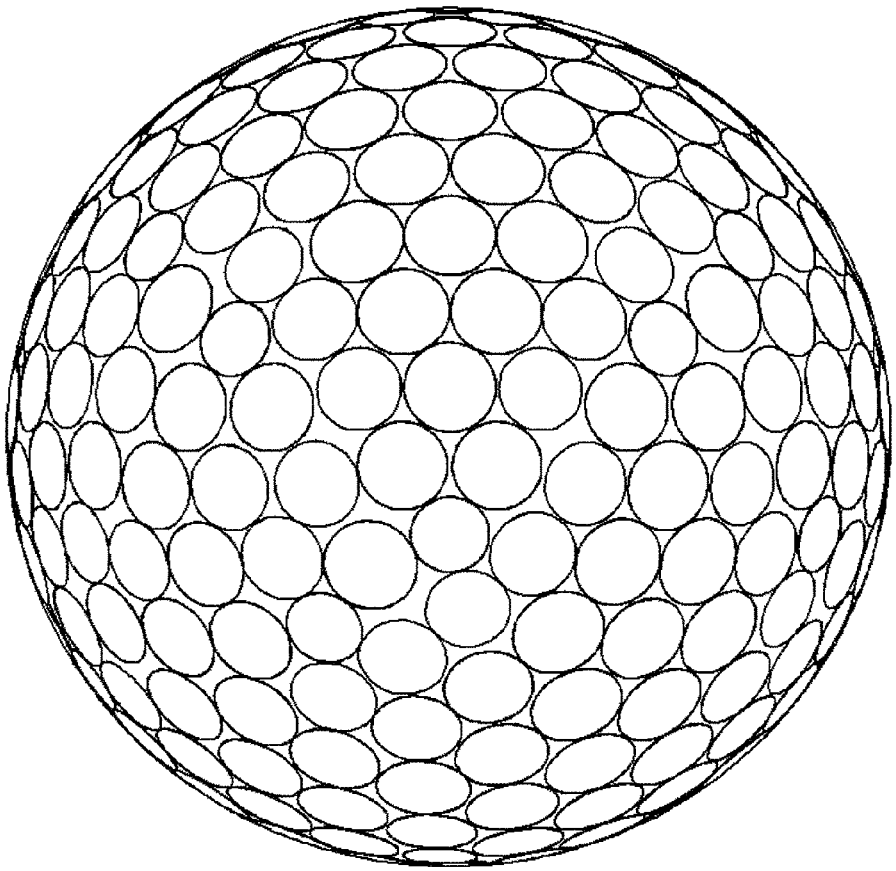
FIG. 9 is a front view of a golf ball according to Example 9 of the present invention.
Figure 10:
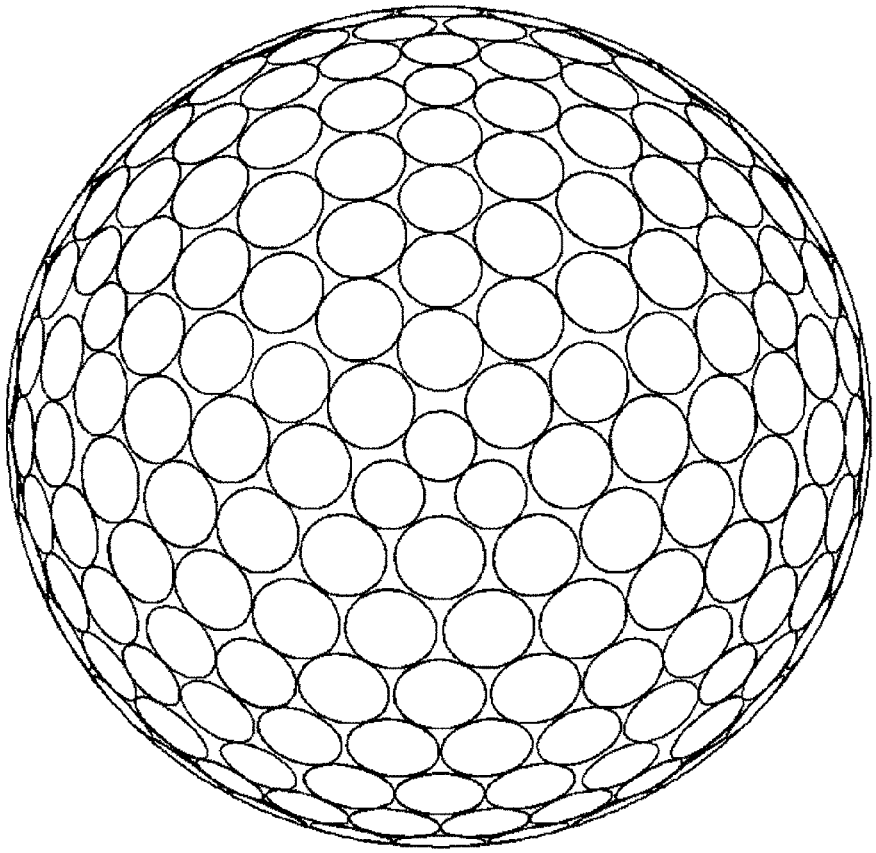
FIG. 10 is a plan view of the golf ball in FIG. 9.
Figure 11:
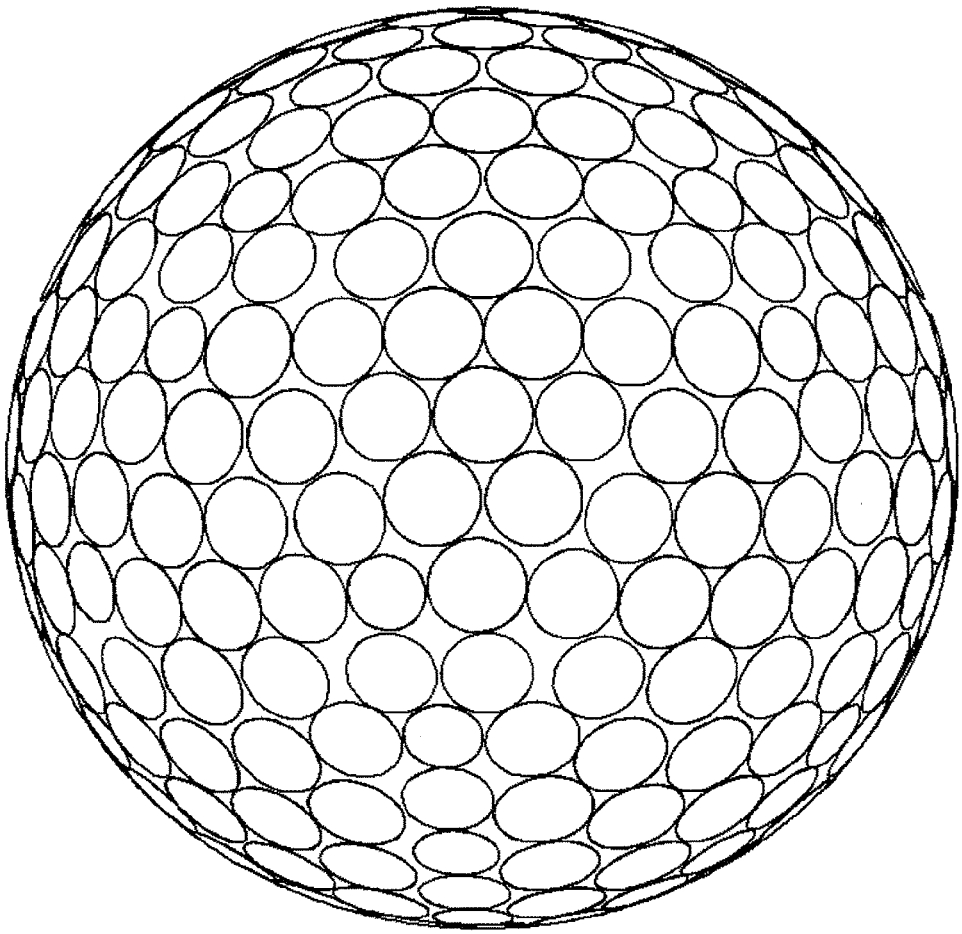
FIG. 11 is a front view of a golf ball according to Example 10 of the present invention.
Figure 12:
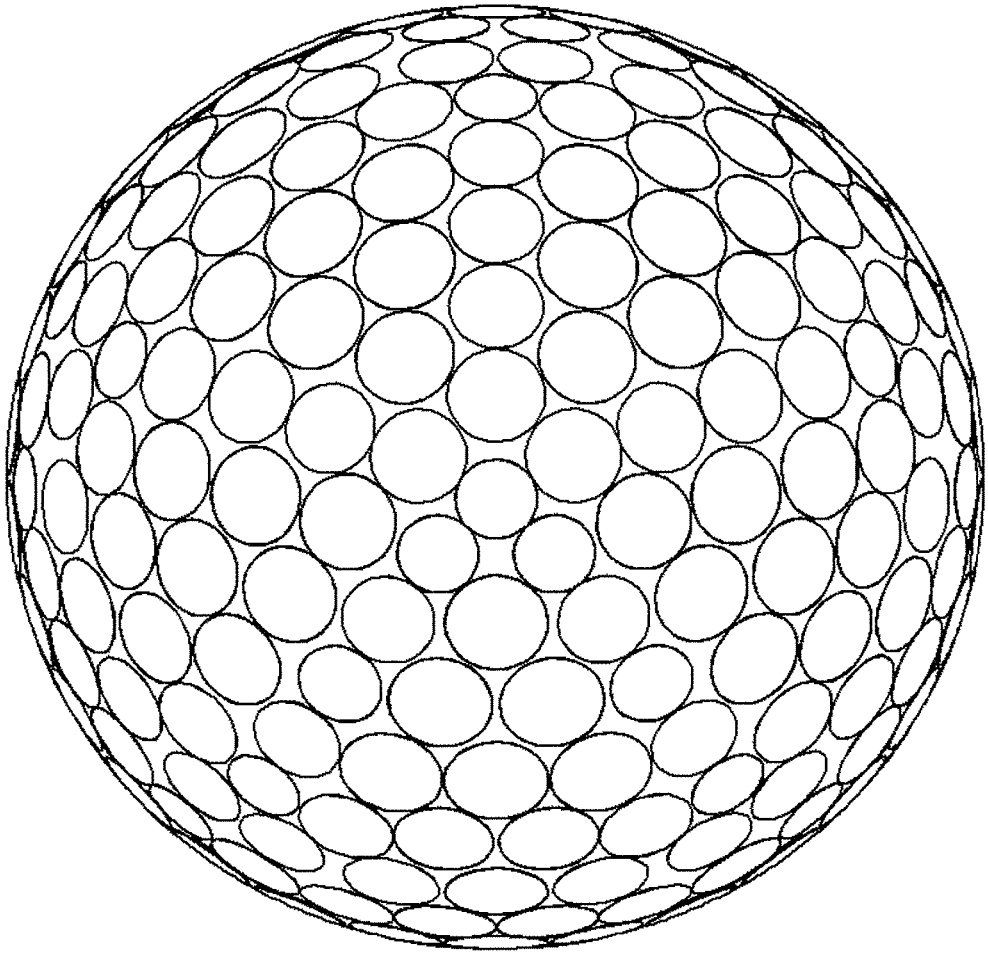
FIG. 12 is a plan view of the golf ball in FIG. 11.

| | D1 | D2 | D3 | D4 |
|---|---|---|---|---|
| Front view | FIG. 2 | FIG. 9 | FIG. 11 | — |
| Plan view | FIG. 3 | FIG. 10 | FIG. 12 | — |
| Rotationally symmetrical angle (degree) | | | | |
| High-latitude region | — | — | — | 90 |
| Mid-latitude region | — | — | 72 | 90 |
| Low-latitude region | — | — | — | 90 |
| Pole vicinity region | 72 | — | — | 90 |
| Equator vicinity region | 60 | — | — | 90 |
| Dimple N1 | 324 | 324 | 322 | 336 |
| Occupation ratio (%) | 84.0 | 83.8 | 81.4 | 77.0 |
| Total volume ($mm^3$) | 325.2 | 324.2 | 315.1 | 325.2 |
| Plane N2 | 1 | 1 | 1 | 4 |
| Great circle path N3 | 0 | 0 | 0 | 3 |

TABLE 4

Results of Evaluation

| | Comp. Ex. 1 | Ex. 2 | Ex. 3 | Ex. 4 | Ex. 5 |
|---|---|---|---|---|---|
| Core | | | | | |
| CD (mm) | 3.9 | 3.9 | 3.9 | 3.9 | 3.9 |
| Diameter (mm) | 37.1 | 36.3 | 36.7 | 36.7 | 36.7 |
| First mid layer | | | | | |
| Composition | — | — | J5 | J4 | J4 |
| Hardness (Shore D) | — | — | 45 | 50 | 50 |
| Thickness (mm) | — | — | 0.8 | 0.8 | 1.2 |
| (Second) mid layer | | | | | |
| Composition | J5 | J5 | J4 | J3 | J3 |
| Hardness (Shore D) | 45 | 45 | 50 | 55 | 55 |
| Thickness (mm) | 1.0 | 1.2 | 1.0 | 1.0 | 1.0 |
| Cover | | | | | |
| Composition | J3 | J4 | J1 | J2 | J2 |

TABLE 4-continued

| Results of Evaluation | | | | | |
|---|---|---|---|---|---|
| | Comp. Ex. 1 | Ex. 2 | Ex. 3 | Ex. 4 | Ex. 5 |
| Hardness (Shore D) | 55 | 50 | 63 | 60 | 60 |
| Thickness (mm) | 1.8 | 2.0 | 1.2 | 1.2 | 0.8 |
| THm | 45.0 | 54.0 | 43.0 | 47.5 | 57.5 |
| THc | 99.0 | 100.0 | 75.6 | 72.0 | 48.0 |
| THc − THm | 54.0 | 46.0 | 32.6 | 24.5 | −9.5 |
| Dimple | D1 | D1 | D1 | D1 | D1 |
| Spin (rpm) | 4100 | 4050 | 4030 | 4010 | 4015 |
| Carry (m) | 141.0 | 141.7 | 142.0 | 142.3 | 142.2 |
| Feeling | A | A | A | A | A |

TABLE 5

| Results of Evaluation | | | | |
|---|---|---|---|---|
| | Ex. 1 | Ex. 6 | Ex. 7 | Ex. 8 |
| Core | | | | |
| CD (mm) | 3.9 | 3.9 | 3.9 | 3.9 |
| Diameter (mm) | 37.5 | 36.7 | 36.7 | 35.1 |
| First mid layer | | | | |
| Composition | — | — | — | — |
| Hardness (Shore D) | — | — | — | — |
| Thickness (mm) | — | — | — | — |
| (Second) mid layer | | | | |
| Composition | J3 | J4 | J3 | J4 |
| Hardness (Shore D) | 55 | 50 | 55 | 50 |
| Thickness (mm) | 1.6 | 2.0 | 2.0 | 2.6 |
| Cover | | | | |
| Composition | J2 | J1 | J1 | J1 |
| Hardness (Shore D) | 60 | 63 | 63 | 63 |
| Thickness (mm) | 1.0 | 1.0 | 1.0 | 1.2 |
| THm | 88.0 | 100.0 | 110.0 | 130.0 |
| THc | 60.0 | 63.0 | 63.0 | 75.6 |
| THc − THm | −28.0 | −37.0 | −47.0 | −54.4 |
| Dimple | D1 | D1 | D1 | D1 |
| Spin (rpm) | 4020 | 4005 | 3995 | 3980 |
| Carry (m) | 142.1 | 142.3 | 142.5 | 142.7 |
| Feeling | A | B | C | D |

TABLE 6

| Results of Evaluation | | | | |
|---|---|---|---|---|
| | Ex. 9 | Ex. 10 | Comp. Ex. 3 | Comp. Ex. 4 |
| Core | | | | |
| CD (mm) | 3.9 | 3.9 | 3.9 | 3.9 |
| Diameter (mm) | 37.5 | 37.5 | 37.5 | 35.1 |
| First mid layer | | | | |
| Composition | — | — | — | — |
| Hardness (Shore D) | — | — | — | — |
| Thickness (mm) | — | — | — | — |
| (Second) mid layer | | | | |
| Composition | J3 | J3 | J3 | J4 |
| Hardness (Shore D) | 55 | 55 | 55 | 50 |
| Thickness (mm) | 1.6 | 1.6 | 1.6 | 2.6 |
| Cover | | | | |
| Composition | J2 | J2 | J2 | J1 |
| Hardness (Shore D) | 60 | 60 | 60 | 63 |
| Thickness (mm) | 1.0 | 1.0 | 1.0 | 1.2 |
| THm | 88.0 | 88.0 | 88.0 | 130.0 |

TABLE 6-continued

| Results of Evaluation | | | | |
|---|---|---|---|---|
| | Ex. 9 | Ex. 10 | Comp. Ex. 3 | Comp. Ex. 4 |
| THc | 60.0 | 60.0 | 60.0 | 75.6 |
| THc − THm | −28.0 | −28.0 | −28.0 | −54.4 |
| Dimple | D2 | D3 | D4 | D4 |
| Spin (rpm) | 4020 | 4020 | 4020 | 3980 |
| Carry (m) | 141.8 | 141.5 | 140.7 | 141.3 |
| Feeling | A | A | A | D |

As shown in Tables 4 to 6, each of the golf balls in Examples is excellent in flight performance. From the results of evaluation, advantages of the present invention are clear.

The golf ball according to the present invention is suitable for playing golf on golf courses, practicing at driving ranges, and the like. The above description is merely for illustrative examples, and various modifications can be made without departing from the principles of the present invention.

What is claimed is:

1. A golf ball comprising a core, one or more mid layers positioned outside the core, and a cover positioned outside the mid layers, wherein:

the cover has a Shore D hardness greater than Shore D hardnesses of each of the mid layers by 2 or greater, an average THm of products obtained by multiplying thickness (mm) by hardness (Shore D) for the respective mid layers, and a product THc of a thickness (mm) and a hardness (Shore D) for the cover satisfy the following mathematical formula:

$$THc-THm\leq 50,$$

the golf ball has a large number of dimples on a surface thereof, when the surface is divided into a northern hemisphere and a southern hemisphere, each of the hemispheres includes a high-latitude region, a mid-latitude region and a low-latitude region, the high-latitude region has a latitude range of equal to or greater than 40° but equal to or less than 90°, the mid-latitude region has a latitude range of equal to or greater than 20° but less than 40°, the low-latitude region has a latitude range of equal to or greater than 0° but less than 20°, the number of planes that can divide a dimple pattern of the hemisphere so that divided dimple patterns having mirror symmetry to each other is one, a dimple pattern of the high-latitude region is not rotationally symmetrical, and a dimple pattern of the low-latitude region is not rotationally symmetrical.

2. The golf ball according to claim 1, wherein the average product THm and the product THc satisfy the following mathematical formula:

$$-50\leq THc-THm.$$

3. The golf ball according to claim 1, wherein a dimple pattern of the mid-latitude region is not rotationally symmetrical.

4. The golf ball according to claim 1, wherein the high-latitude region includes a pole vicinity region, the pole vicinity region has a latitude range of equal to or greater than 75° but equal to or less than 90°, and a dimple pattern of the pole vicinity region is rotationally symmetrical.

5. The golf ball according to claim 1, wherein the low-latitude region includes an equator vicinity region, the equator vicinity region has a latitude range of equal to or greater than 0° but less than 10°, and a dimple pattern of the equator vicinity region is rotationally symmetrical.

6. The golf ball according to claim 1, wherein a great circle that does not intersect any dimple does not exist on the surface thereof.

7. The golf ball according to claim 1, wherein a ratio of a total area of the dimples to a surface area of a phantom sphere of the golf ball is equal to or greater than 80%.

* * * * *